US008408832B2

(12) United States Patent
Andochick

(10) Patent No.: US 8,408,832 B2
(45) Date of Patent: Apr. 2, 2013

(54) ADJUSTABLE LENGTH PEN HOLDER

(76) Inventor: Scott E. Andochick, Potomac, MD (US)

( * ) Notice: Subject to any disclaimer, the term of this patent is extended or adjusted under 35 U.S.C. 154(b) by 565 days.

(21) Appl. No.: 12/541,532

(22) Filed: Aug. 14, 2009

(65) Prior Publication Data

US 2011/0038659 A1 Feb. 17, 2011

(51) Int. Cl.
*A46B 11/00* (2006.01)

(52) U.S. Cl. ..... 401/48; 401/195; 401/88

(58) Field of Classification Search ..... 401/52, 401/88, 30, 109, 112, 116, 117, 131, 195, 401/48

See application file for complete search history.

(56) References Cited

U.S. PATENT DOCUMENTS

| | | | | |
|---|---|---|---|---|
| 1,679,382 | A | 8/1928 | Sjobring | |
| 2,236,194 | A | 3/1941 | Lorber | |
| 2,291,859 | A | 8/1942 | Andrews | |
| 3,159,372 | A * | 12/1964 | McIntosh | 248/683 |
| 4,618,280 | A | 10/1986 | Kageyama | |
| 4,729,686 | A | 3/1988 | Ambasz | |
| 4,854,762 | A | 8/1989 | Hubbard | |
| 5,823,494 | A | 10/1998 | Jones et al. | |
| 6,019,535 | A | 2/2000 | Turner | |
| 6,290,413 | B1 * | 9/2001 | Wang | 401/30 |
| 6,409,404 | B1 | 6/2002 | Piech | |
| 6,464,420 | B2 | 10/2002 | Brunetti | |
| D485,297 | S | 1/2004 | Reda et al. | |
| 6,719,470 | B2 | 4/2004 | Berhin | |
| D497,180 | S | 10/2004 | Cetera | |
| 6,830,402 | B2 | 12/2004 | Sunatori | |
| D501,879 | S | 2/2005 | Martin | |
| 6,981,812 | B1 | 1/2006 | Hsieh | |
| 7,101,103 | B1 * | 9/2006 | Dietz | 401/195 |
| 7,350,996 | B2 | 4/2008 | Bielecki et al. | |
| 7,390,137 | B1 * | 6/2008 | Rentz | 401/112 |
| 2008/0226378 | A1 | 9/2008 | Sheu | |
| 2009/0016800 | A1 | 1/2009 | Barthakur | |

* cited by examiner

*Primary Examiner* — David Walczak

(57) ABSTRACT

A pen holder includes an upper housing for receiving and holding an upper end of a writing implement and a lower housing adapted to receive the writing end of the writing implement. The lower housing has a hole at its lower end that is sized to allow the writing tip of the writing implement to pass through, and the lower housing being removably coupled to the upper housing to form a chamber that at least partially encloses the writing implement. The length of the chamber, or the longitudinal position of the writing implement within the chamber, is variable to accommodate writing implements of different lengths.

14 Claims, 5 Drawing Sheets

ADJUSTABLE LENGTH PEN HOLDER

BACKGROUND

Ball point pens are available in a wide variety of types and prices, from expensive pens with replaceable cartridges to low-cost stick pens.

A disadvantage of a stick pen is that its cap is easily misplaced. A further disadvantage is that its narrow width makes it less comfortable to write with than a wider pen.

A disadvantage of a pen with a replaceable cartridge is that the cartridges are relatively expensive to replace. Further, since each cartridge is designed for use with a specific type of pen, the cartridges may not be widely available.

BRIEF DESCRIPTION OF THE FIGURES

The accompanying figures, in which like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
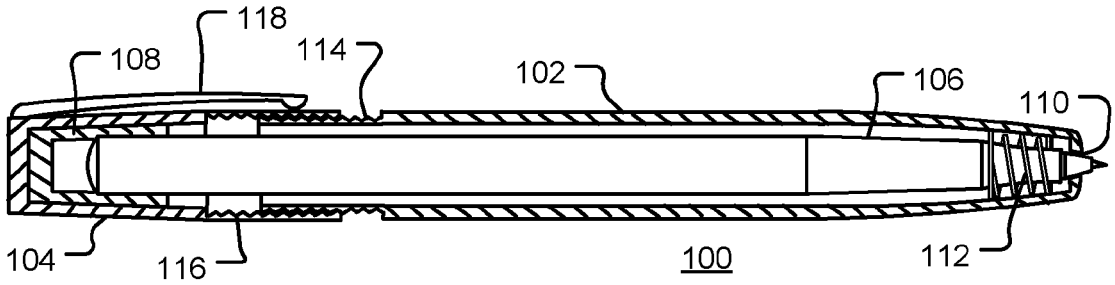
FIG. 1 is a sectional view of an exemplary pen holder in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to a pen holder. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by the phrase "comprises . . . a" does not, without more constraints, preclude the existence of additional identical elements in the process, method, article, or apparatus that comprises the element.

The present invention relates to pen holder that is able to hold a low-cost stick pen or pencil. Further, in one mode of operation the writing end of the stick pen protrudes from the pen holder such that pen holder may be used as a pen for writing. In this way, the pen holder functions as a pen with the stick pen functioning as a cartridge.

In this way, the pen holder has many of the benefits of a conventional cartridge pen, but has the additional advantages that the cartridge is a stick pen or pencil that is both cheap and widely available.

FIG. 1 is a sectional view of an example pen holder 100 in accordance with some embodiments of the invention. Referring to FIG. 1, the pen holder 100 comprises lower housing 102 and an upper housing 104 that may be joined together to hold a stick pen 106. In this embodiment, the stick pen 106 is held in place by a compliant material 108 that lines a portion of the upper housing 104. The compliant material may be rubber or a rubber-like material. The cavity formed by the compliant material 108 is tapered so as to accommodate stick pens of various diameters. In a further embodiment the compliant material may be omitted. In this embodiment, the cavity formed by the upper housing 104 is tapered to accommodate stick pens of various diameters.

The writing-end of the stick pen 106 is held in a tapered hole 110 in the end of the lower housing 102. The taper allows stick pens of various sizes to be held. The tapered hole 110 is sized such that the writing end of the stick pen 106 may extend beyond the lower housing 102 in one mode of operation.

In one embodiment, a spring 112 positioned at the end of the lower housing is oriented to apply a spring force to the stick pen 106. The force tends to push the stick pen into the tapered cavity in the upper housing 104 and thus hold the pen securely. The spring may act directly onto the stick pen, or may act on a washer through which the stick pen passes.

The features described above enable stick pens of various diameters to be used. To accommodate stick pens of different lengths, the overall or internal length of the pen holder 100 may be varied. This may be achieved by a variety of means well known to those of ordinary skill in the art. In the embodiment shown in FIG. 1, the upper and lower housings are joined by screw threads 114 and 116 on the lower and upper housings, respectively. The desired length may be maintained by a locking mechanism or simply by friction. The upper housing may screw over the lower housing, as shown in the figure, or the lower housing may screw over the upper housing.

A further advantage of a variable length pen holder is that the length may be increased to the extent that the stick pen is completely within the pen holder. This allows the pen holder to be placed in a pocket without marking clothing, and also protects the writing end of the stick pen.

A clip 118 may be attached to the upper housing 104 to allow the pen holder 100 to be securely carried in a pocket or clipped to a writing pad.

Figure 2:
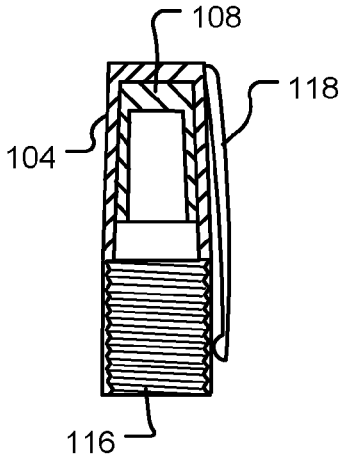
FIG. 2 is a sectional view of an exemplary upper housing of a pen holder in accordance with some embodiments of the invention.

FIG. 2 is a sectional view of an example upper housing of a pen holder 100 in accordance with some embodiments of the invention. Optionally, a compliant material 108 lines a portion of the upper housing 104. In a further embodiment the compliant material may be omitted, and the cavity formed by the upper housing 104 is tapered to accommodate stick pens of various diameters.

Figure 3:
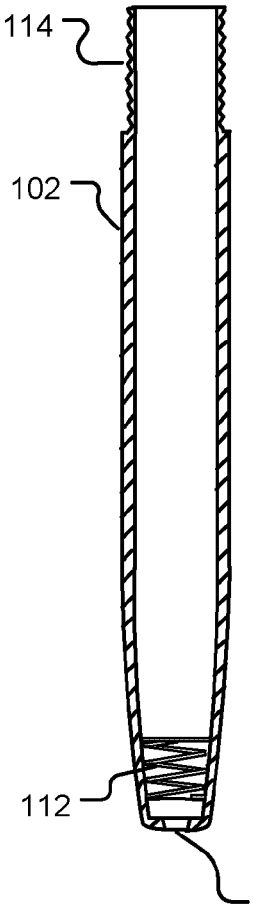
FIG. 3 is a sectional view of an exemplary lower housing of a pen holder in accordance with some embodiments of the invention.

FIG. 3 is a sectional view of an example lower housing of a pen holder in accordance with some embodiments of the invention. In this example, the upper end 114 of the housing is threaded and the lower end includes a tapered hole 110 to accommodate a stick pen. A spring 112 may be used to hold the stick pen in place when the pen holder is lengthened.

Figure 4:
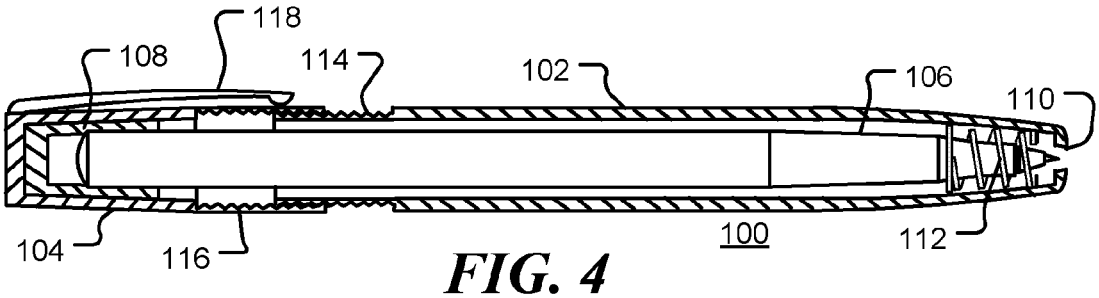
FIG. 4 is a further sectional view of an exemplary pen holder in accordance with some embodiments of the invention.

FIG. 4 is a further sectional view of an example pen holder 100 in accordance with some embodiments of the invention. Referring to FIG. 4, the pen holder 100 comprises lower housing 102 and an upper housing 104 that may be joined together to hold a stick pen 106. In this embodiment, the stick pen 106 is held in place in the upper housing by a compliant material 108 that lines a portion of the upper housing 104 and by a bias spring 112 that acts between the stick pen 106 and the lower end of the lower housing 102 and pushes the stick pen 106 towards the upper housing 104. In the view shown in FIG. 4, the pen holder 100 has been lengthened so that the stick pen is retracted. That is, the stick pen is held entirely within the pen holder 100. The interior of the pen holder 100 may be lengthened by various means known to those of ordinary skill in the art, including by use of retraction mechanisms such as those used in 'click' pens. Rotating the upper housing 104 relative to the lower housing 102 shortens the pen holder 100 and causes the writing end of the stick to be extended through the hole 110 in the lower housing 102.

Figure 5:
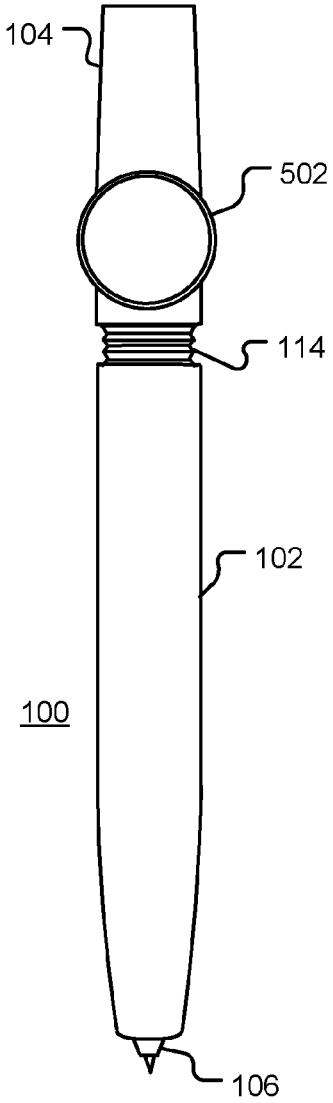
FIG. 5 is a diagrammatic representation of a pen holder with an attached magnet, in accordance with certain embodiments of the present invention.

FIG. 5 is a diagrammatic representation of a pen holder 100 in accordance with certain embodiments of the present invention. Referring to FIG. 5, a magnet 502 is attached, either fixedly or removably, to the pen holder 100. The magnet 502 enables the pen holder 100 to be attached to ferrous objects such as metal furniture, or wearable holders, for example.

Figure 6:
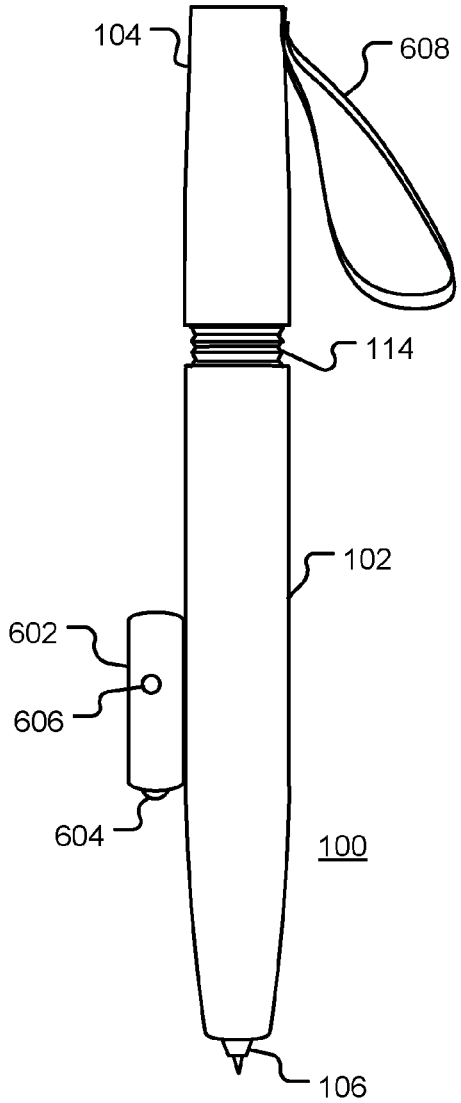
FIG. 6 is a diagrammatic representation of a pen holder with a light generator and strap or loop, in accordance with certain embodiments of the present invention.

FIG. 6 is a further diagrammatic representation of a pen holder 100 in accordance with certain embodiments of the present invention. Referring to FIG. 6, a light generator 602 is attached, either fixedly or removably, to the pen holder 100. The light generator 602 emits light through element 604 towards to the writing end of the pen holder 100. This enables the writing surface to be illuminated when the pen holder 100 is used for writing. Optionally, operation of the light generator 602 may be controlled by a switch 606. The light generator may be powered by any of variety of means, including a battery or a device that converts motion to electricity or light.

In some embodiments, the pen holder 100 may include a strap or loop 608 that facilitates carrying or storage of the pen holder. The loop may be constructed of a flexible material, such as a cord or chain, or it may be constructed of a more rigid material such as plastic.

The pen holder may be partially or completely constructed of a fluorescent material to enable the pen holder to be found more easily in low lighting conditions.

Figure 7:
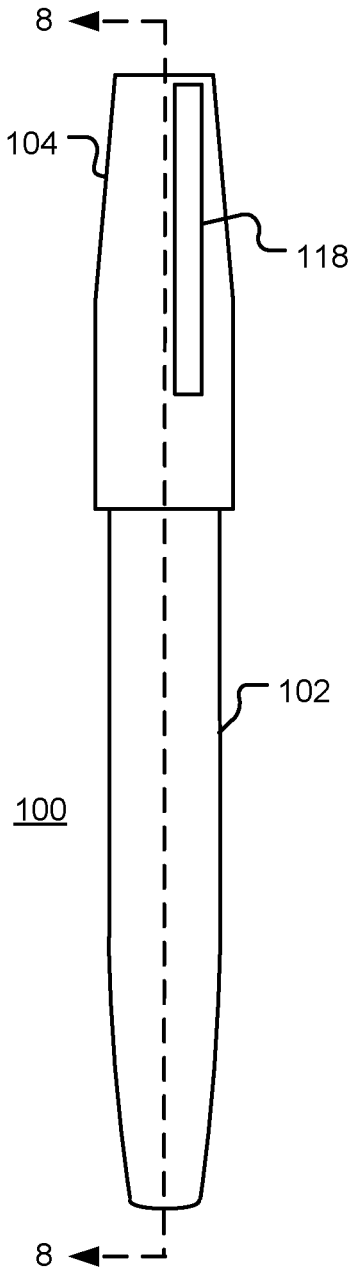
FIG. 7 is a diagrammatic representation of a pen holder, in accordance with certain further embodiments of the present invention.
Figure 8:
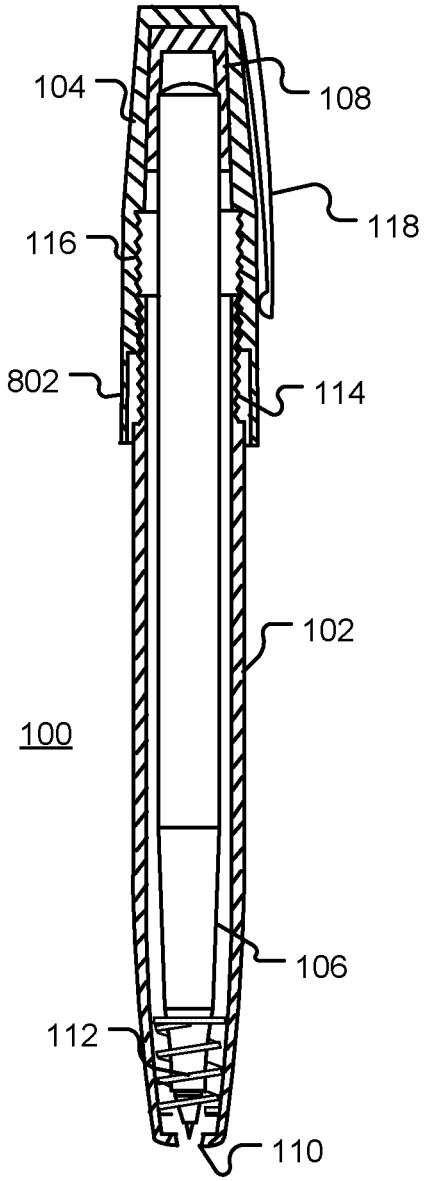
FIG. 8 is a further sectional view of the pen holder shown in FIG. 7.

FIG. 7 is a diagrammatic representation of a further pen holder 100, in accordance with certain further embodiments of the present invention. In this embodiment, the thread connecting the lower housing 102 to the upper housing 104 is obscured by the upper housing. This is shown in more detail in FIG. 8, which is a sectional view through the section 8-8 of the pen holder 100 shown in FIG. 7. Referring to FIG. 8, the upper housing 104 includes an extended region 802 that extends beyond the threaded region 116 of the upper housing. The extended region 802 covers the threaded region 114 of the lower housing 102, even when the stick pen 106 is retracted inside the pen holder 100, as shown in the FIG. 8. As described above, the threaded regions of the upper and lower housings allow the length of the pen holder 100 to be varied. This allows stick pens 106 of different lengths to be accommodated and also allows the stick pen 106 to retracted for storage or extended for writing.

Figure 9:
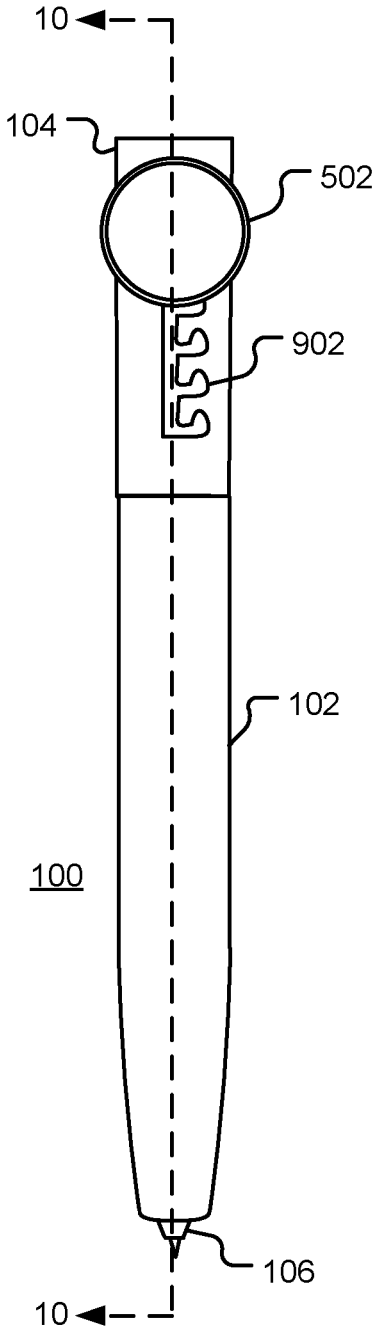
FIG. 9 is a diagrammatic representation of a pen holder with an attached magnet, in accordance with further embodiments of the present invention.
Figure 10:
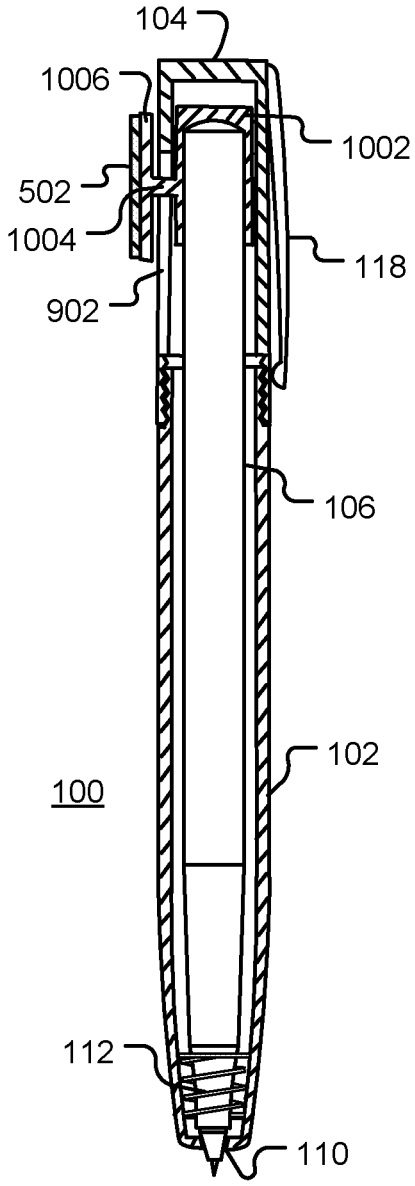
FIG. 10 is a sectional view of the pen holder shown in FIG. 9.

FIG. 9 is a diagrammatic representation of a pen holder 100 with an attached magnet 502, in accordance with further embodiments of the present invention. In this embodiment the upper housing 104 includes a notched slot 902. The notched slot 902 includes a number of notches. A view through the section 10-10 is shown in FIG. 10. Referring to FIG. 10, the upper end of stick pen 106 is held in inner housing 1002. The inner housing is sized such that it can slide within the upper housing 104, allowing the stick pen 106 to move longitudinally within the pen holder 100. This, in turn, allows pens 106 of different lengths to be accommodated and also allows the pen 106 to retracted for storage or extended for writing. A post 1004 extends from the inner housing 1002, through the notched slot 902 in the upper housing 104 and connects to positioning element 1006, outside of the upper housing 104. In this embodiment, a magnet 502 is attached to the positioning element 1006. In operation, spring 112 biases the post 1004 into a notch of the notched slot 902. The user may use the positioning element 1006 (and the optional attached magnet 502) to position the post 1004 in a selected notch of the notched slot 902. This, in turn adjusts the position of the pen within the pen holder 100. In this manner, pens 106 of different lengths may be accommodated. By selecting the appropriate notch of the notched slot 902, the pen 106 may be retracted for storage or extended for writing. The bias spring 112 prevents the post 1004 from slipping from the selected notch. Further, the pressure of writing with the pen 106 holds the post 1004 in the selected notch. In this embodiment the bias spring 112 is in compression.

In one embodiment, the positioning element 1006 is simply the exterior end of the post 1004.

Figure 11:
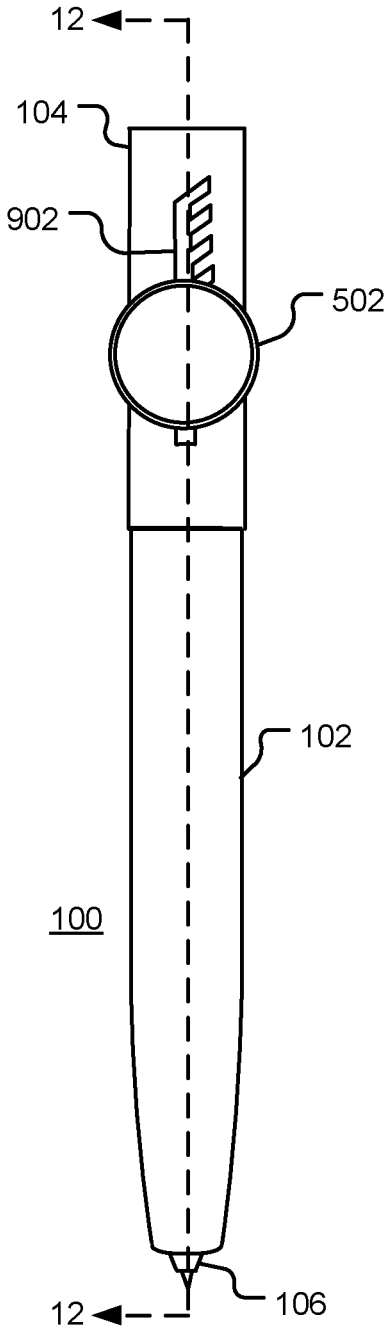
FIG. 11 is a diagrammatic representation of a pen holder with an attached magnet, in accordance with still further embodiments of the present invention.

A further embodiment is shown in FIGS. 11. Referring to FIG. 11, the shape of the notches is varied compared to FIG. 9, so as to illustrate that notches and slots of various geometries may be used without departing from the present invention.

In the description above, the use of the pen holder to hold a stick pen is described. However, the pen holder may also be used to hold other writing implements, such as pencils, for example.

Figure 12:
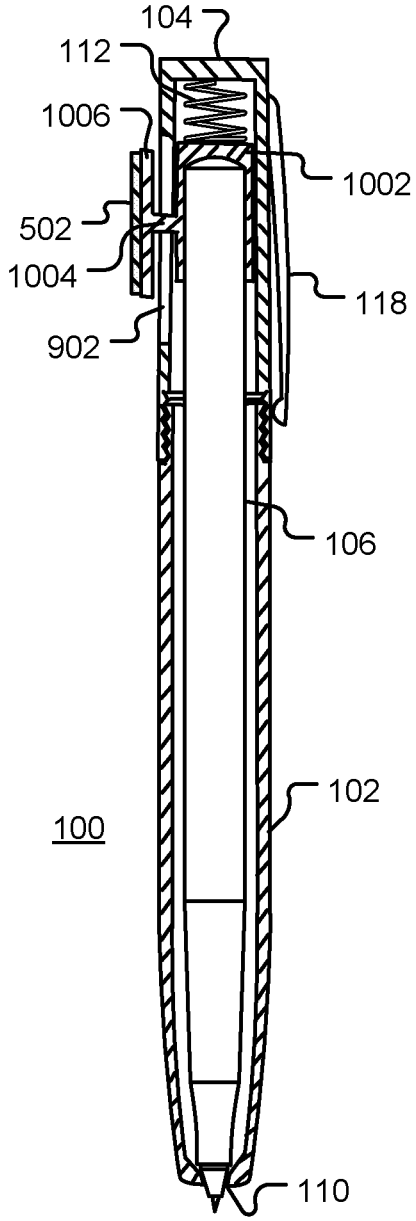
FIG. 12 is a sectional view of the pen holder shown in FIG. 11.

A view through the section 12-12 in FIG. 11 is shown in FIG. 12. Referring to FIG. 12, the upper end of stick pen 106 is held in inner housing 1002. The inner housing is sized such that it can slide within the upper housing 104, allowing the stick pen 106 to slide within the pen holder 100. This, in turn, allows pens 106 of different lengths to be accommodated and also allows the pen 106 to retracted for storage or extended for writing. A post 1004 extends from the inner housing 1002, through the notched slot 902 in the upper housing 104 and connects to positioning element 1006, outside of the upper housing 104. In this embodiment, a magnet 502 is attached to the positioning element 1006. In operation, spring 112 biases the post 1004 into a notch of the notched slot 902. The user may use the positioning element 1006 (and the optional attached magnet 502) to position the post 1004 in a selected notch of the notched slot 902. This, in turn adjusts the position of the pen within the pen holder 100. In this manner, pens 106 of different lengths may be accommodated. By selecting the appropriate notch of notched slot, the pen 106 may be retracted for storage or extended for writing. The bias spring 112 prevents the post 1004 from slipping from the selected notch. Further, the pressure of writing of writing with the pen 106 holds the post 1004 in the selected notch. In this embodiment the bias spring 112 is in tension and couples between the upper housing 104 and the inner housing 1002. Movement of the inner housing 1002 allows the interior length of the pen holder 100 to be varied.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A pen holder comprising:

an upper housing;

an elastomeric lining located within and in at least partial contact with the upper housing; and a lower housing adapted to receive a writing end of a writing implement, the lower housing having a hole at its lower end sized to allow the writing end of the writing implement to pass through, and the lower housing being removably coupled to the upper housing to form a chamber that at least partially encloses the writing implement;

wherein the length of the chamber is variable to accommodate writing implements of different lengths, and wherein the upper housing and the elastomeric lining form a tapered cavity adapted to receive and hold the upper end of writing implements of a range of diameters.

2. A pen holder in accordance with claim 1, wherein the lower housing is removably coupled to the upper housing by a screw thread.

3. A pen holder in accordance with claim 1, further comprising a magnet attached to at least one of the upper and lower housings.

4. A pen holder in accordance with claim 1, further comprising a loop attached to the upper housing.

5. A pen holder in accordance with claim 1, further comprising a light generator attached to at least one of the upper and lower housings, the light generator being operable to shine light in the direction towards the lower end of the pen holder.

6. A pen holder in accordance with claim 1, further comprising a spring located in the lower housing, wherein the spring is configured to apply a bias force to the writing implement to push the writing implement in the direction towards the upper housing.

7. A pen holder in accordance with claim 1, wherein the pen holder is at least partially constructed of a fluorescent material.

8. A pen holder in accordance with claim 1, further comprising a means for retracting the writing implement into the pen holder.

9. A pen holder adapted to hold a writing implement having an upper end and a writing end, comprising:

an upper housing that includes a notched slot, having a plurality of notches;

a lower housing adapted to receive the writing end of the writing implement, the lower housing having a hole at its lower end sized to allow the writing end of the writing implement to pass through, and the lower housing being removably coupled to the upper housing to form a chamber that at least partially encloses the writing implement;

an inner housing adapted to hold the upper end of the a writing implement, the inner housing having a post that extends from the inner housing through the notched slot; and a bias spring, configured to apply a longitudinal bias force to the post, the bias force tending to bias the post into a notch of the plurality of notches of the notch slot;

wherein the longitudinal position of the inner housing is adjustable by moving the post into a selected notch of the plurality of notches of the notched slot in the upper housing, the movement achieved by rotating the inner housing to move the post out of a first notch, sliding the inner housing in a longitudinal direction and rotating the inner housing to move the post into the selected notch.

10. A pen holder in accordance with claim 9, wherein the post is adapted to be placed in a first notch of the plurality of notches such that a writing implement held in the inner housing is extended from the pen holder for writing and wherein the post may be placed in a second notch of the plurality of notches such that the writing implement is retracted within the pen holder for storage.

11. A pen holder in accordance with claim 10, further comprising:

a positioning element, coupled to the exterior end of the post, wherein the positioning element may be used to position the post in a selected notch of the plurality of notches.

12. A pen holder in accordance with claim 11, further comprising a magnet coupled to the positioning element, the magnet having sufficient strength to support the weight of the pen holder and the writing implement held by the pen holder when the magnet is attached to a magnetic surface.

13. A pen holder in accordance with claim 9, wherein the lower housing is removably coupled to the upper housing by a screw thread.

14. A pen holder in accordance with claim 9, wherein the inner housing is sized to hold a stick pen and is sized to hold a pencil.

* * * * *